US005662530A

United States Patent [19]

Sellar

[11] Patent Number: 5,662,530

[45] Date of Patent: Sep. 2, 1997

[54] GOLF BALL

[76] Inventor: John G. Sellar, 6045 W. Evans Pl., Lakewood, Colo. 80227

[21] Appl. No.: 288,606

[22] Filed: Aug. 10, 1994

[51] Int. Cl.[6] ..... A63B 69/36; A63B 37/14

[52] U.S. Cl. ..... 473/268; 473/353; 40/327

[58] Field of Search ..... 273/213, 232; 473/280, 353, 165, 268; 40/327

[56] References Cited

U.S. PATENT DOCUMENTS

| | | | |
|---|---|---|---|
| 676,506 | 6/1901 | Knight et al. | 273/213 |
| 1,795,732 | 3/1931 | Miller | 273/213 |
| 4,235,441 | 11/1980 | Ciccarello | 273/213 |
| 4,258,921 | 3/1981 | Worst | 273/232 |
| 4,346,898 | 8/1982 | Badke | 273/232 |
| 4,706,958 | 11/1987 | Inoue | 273/213 |
| 4,798,386 | 1/1989 | Berard | 273/235 R |
| 5,013,046 | 5/1991 | Koch | 273/235 R |
| 5,067,719 | 11/1991 | Mook | 273/213 |
| 5,127,655 | 7/1992 | Yamada et al. | 273/232 |
| 5,209,485 | 5/1993 | Nesbitt et al. | 273/235 R X |

*Primary Examiner*—George J. Marlo

[57] ABSTRACT

A golf ball providing better putting results from the placement of lands along intersecting, cartographically speaking, longitudinal great circles and latitudinal circles in a manner that permits the golfer to align the putter with the hole by viewing a line of lands running over the upper surface of a golf ball while simultaneously placing an opposed bottom land on the putting green and a second land at a position 90° from the bottom land for contact with the putter when the top and bottom lands are perpendicular to the surface of the green.

The circles can be at 30°, 45° or 90° apart. Preferably, the circles are 45° or 90° apart, the lands are sized from 5 mm to 10 mm and cover up to about 20% of the ball surface. Preferably, the lands are colored.

10 Claims, 1 Drawing Sheet

GOLF BALL

BACKGROUND OF THE INVENTION

Golf ball surface designs have changed over the years as better materials, better land and dimple designs and better sighting indicia have evolved. However, a study of the art indicates that there are no theoretical or empirical theories which lead to the "best" designs for one or more purposes as the following discussion shows. A major design trend has been toward a maximum of dimple area and a minimum of land area. This trend finds it epitome in the Excalibur ELT/Tour model marketed by Excalibur Golf Co. of Farmington Hills, Mich. This ball has dimples of different diameters and, effectively, no lands. U.S. Pat. No. 5,033,750 to Hisashi Yamagishi teaches the use of dimples of three different depths.

U.S. Pat. No. 4,722,529 to Michael Shaw et al, however, teach an improved average flight distance with a ball having at least 30 dumb bell shaped bald spots or "lands" arranged on the ball surface so as to form dodecahedrons.

Another trend is to provide indicia for the desired direction of roll. This design trend is exemplified by U.S. Pat. No. 676,506 to R. D. Knight et al who applied lines to the ball surface and U.S. Pat. No. 4,258,921 to J. C. Worst who puts an "undimpled" patch 90°–100° from the center of the imprint of the brand name. Still another approach is to place an inverted "T" on the ball surface at the sweet spot. When putting, the club is aligned with the bar of the "T" and, when driving, the base is aligned with the drive direction (Brookstone collection, Spring 1994, p. 19).

Still another trend is to place dimples so as to form lands along geometrically positioned patches of dimples. The following patents exemplify various approaches.

U.S. Pat. No. 4,142,727 to Michael Shaw et al teaches a ball having a surface dimple pattern which provides at least 12 symmetrically disposed rectangular bald patches. U.S. Pat. No. 3,819,190 to D. A. Nepela et al teaches a design with two bald poles and a dimpled equator. U.S. Pat. No. 4,762,326 to William Gobush teaches a pattern design with seven great circles which, in truncated octahedron form, form six squares each of which breaks down into four equal isosceles triangles. U.S. Pat. No. 5,046,742 to G. T. Mackey teaches a "soccer" ball design of hexagons and pentagons and uses dimples of differing sizes to form lands of different sizes. U.S. Pat. No. 5,078,402 to Kengo Oka teaches a cuboctahedron design of triangles and squares with uneven dimpling which forms lands of varying sizes. U.S. Pat. No. 5,252,132 to Kengo Oka teaches a ball with 40 or more rectangular lands. U.S. Pat. No. 4,787,638 to Masashi Kobayashi teaches balls having lands and dimples which are covered with even smaller dimples.

While these and other references address different land and dimple golf ball designs, professionals and duffers alike continue to miss softly-tapped putts from short distances. It appears from a study of the problem of erratic rolls from softly tapped putts, that the dimples interaction with the putter surface and/or the grass of the green is greater with slow moving putts than with faster moving putts.

In hard impact golf shots such as long putts, driving and iron play, the impact of the club on the ball causes the ball to compress, which in turn flattens an area of the ball surface against the club head. For these harder blows, the irregularities on the surface of the ball caused by dimples have little effect on the initial direction of the ball, since the dimples are flattened. However, for softly tapped putts, the irregular surface pattern caused by dimples can detrimentally affect the initial direction of the ball. If a golf ball is set on a hard surface, it wobbles until it settles flush across a dimple. Depending on the number of dimples, the angular rotation required to move to the next flush dimple position can range between approximately 7 and 12 degrees. The same is true if the putter head taps the ball softly on a land or dimple as the force of the blow is transmitted directly through the center of the ball casing, the ball will travel truly in line with the putter stroke if irregularities in the turf do not skew the ball path.

However, if the putter contacts a dimple off center i.e., partially on a land edge and a dimple, the force of the putting stroke is not transmitted through the center of the ball. This not only sets the ball off at a tangent, but produces a moment about the center of the ball resulting in a small amount of spin. If the point of contact is only 5 degrees offset from a line through the center of the ball in the direction of the putting stroke, then the tangential misdirection alone over a two foot putt calculates to 2.1 inches—enough to miss the cup.

An additional effect on the initial direction of the ball can be caused by the orientation of the dimple at the point of contact with the ground. Due to dimples, the outside shape of the contact area with the turf is generally hexagonal. If this hexagonal area is symmetrical about a line drawn through the center of the dimple in the direction of the intended putt, then the lateral effect of the hexagon on the putt will be zero. If it is asymmetrical, then the hexagon will affect the initial direction, either to the left or right, of the intended direction.

The present invention ameliorates these effects, by ensuring that during the putting stroke, the golfer can align the ball so that a land is in contact with the ground while, simultaneously, a second land can be contacted by the putter head. The sighting of the putt along the line of lands on the rear, top and front center axis of the line of the desired ball roll also ensures that the golfer can better align a putt or a drive.

Depending on the type of projection utilized in portraying a golf ball, and the positioning of the lands, the land design can be portrayed in terms of imaginary great circles alone or as a combination of great circles and complementary great circles, i.e., a great circle which can be drawn on lands formed by other great circles, e.g., the great circle around the surface of the ball as shown in FIG. 1. For the purposes of this invention, complementary great circles are ignored.

SUMMARY OF THE INVENTION

A better putting result is obtained with a golf ball having opposed substantially smooth areas (lands) on at least two intersecting great circles which are at an acute or right angle. Preferably there are at least six lands in positions located 90° from each other on latitudinal and longitudinal circles on the ball and the lands are about 6 mm to 10 mm in diameter. Preferably, there are no more than about 26 lands symmetrically positioned on vertical and horizontal great circles at least 45° apart around the circumference of the ball.

DETAILED DESCRIPTION OF THE FIGURES

Figure 1:
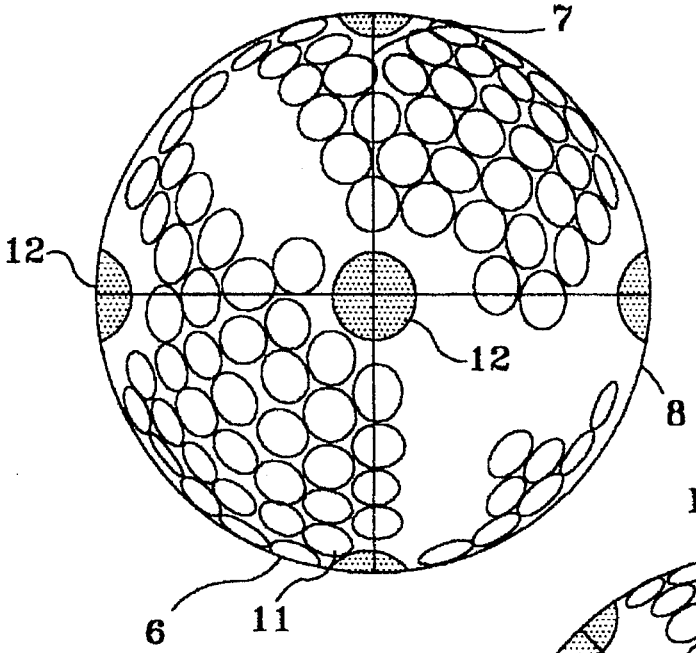
FIG. 1 shows a preferred golf ball having the minimum six lands.

FIG. 1 shows a projection of a spherical golf ball 6 which has longitudinal great circles 7 and an equatorial latitudinal great circle 8 which is perpendicular to circles 7. There are no circles 9 at other latitudes with dimples 11 (which cover the surface but are only partially shown) and 6 mm diameter lands 12 (reverse land not shown). The lands have been colored to allow the golfer to more easily see the lands and to align the ball 10 and the hole in a way which ensures that the contact point between each of the putter and ball and the ball and grass is, effectively, on a land so as to reduce skewing effects.

Figure 2:
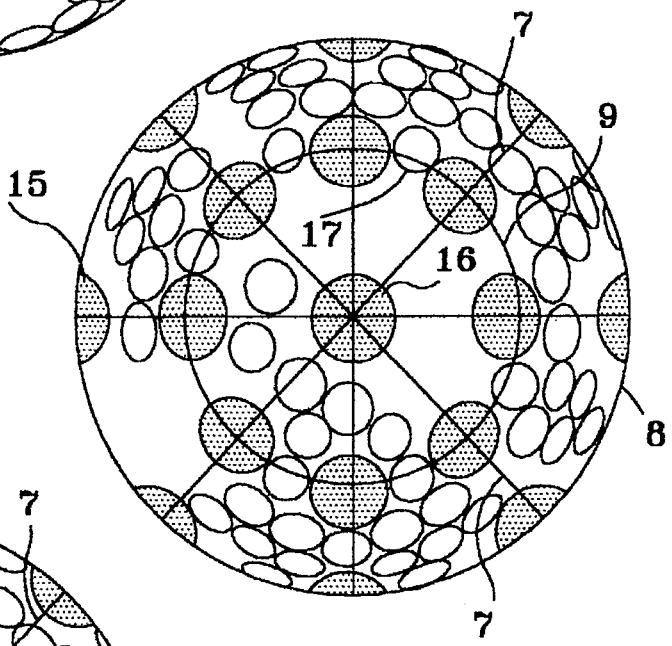
FIG. 2 shows a golf ball with lands at spaced 45° around the ball.

FIG. 2 shows a preferred embodiment of a ball 15 where there are four longitudinal great circles 7 spaced 45 degrees apart, an equatorial latitudinal great circle 8 and one latitudinal circle 9 on the intersections which 26 lands 16 are placed. Again only a portion of the dimples 17 are shown.

Figure 3:
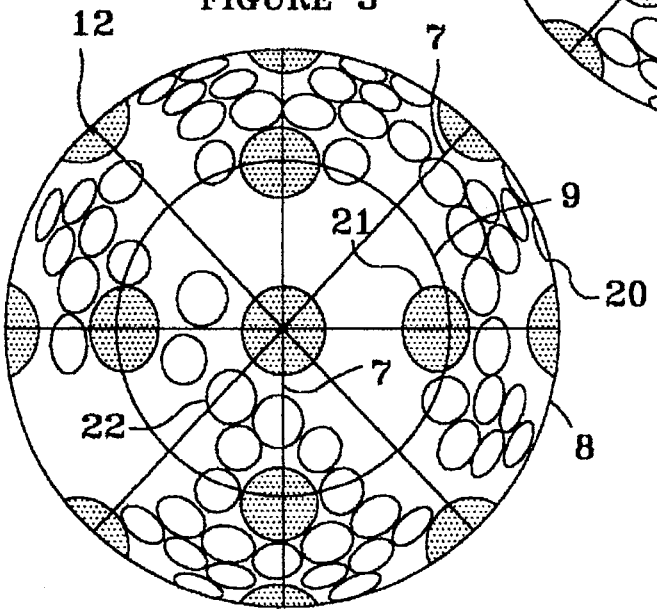
FIG. 3 shows a ball with lands with different numbers of lands displayed at the intersections of latitudinal and longitudinal circles.
Figure 1:
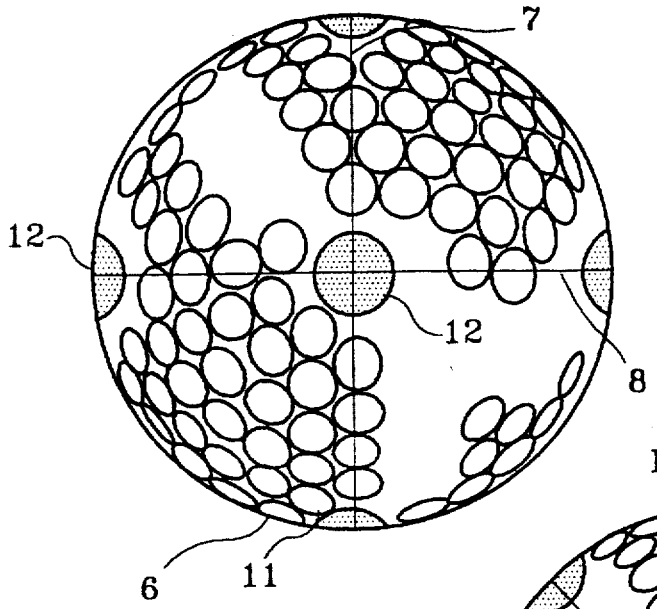
Figure 2:
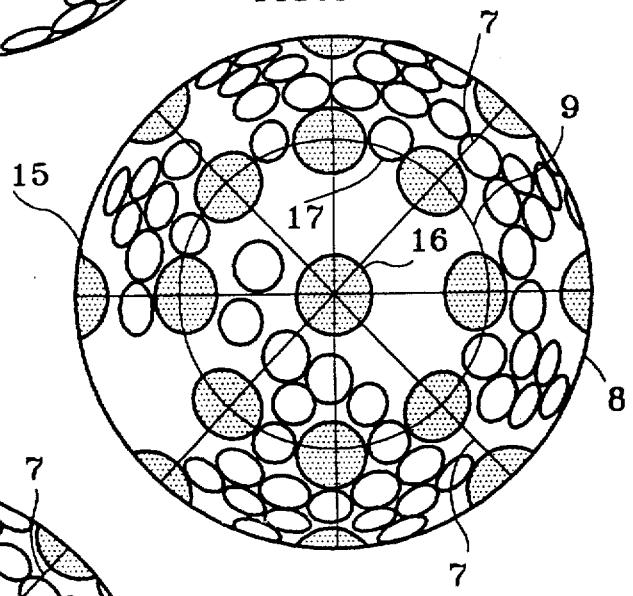
Figure 3:
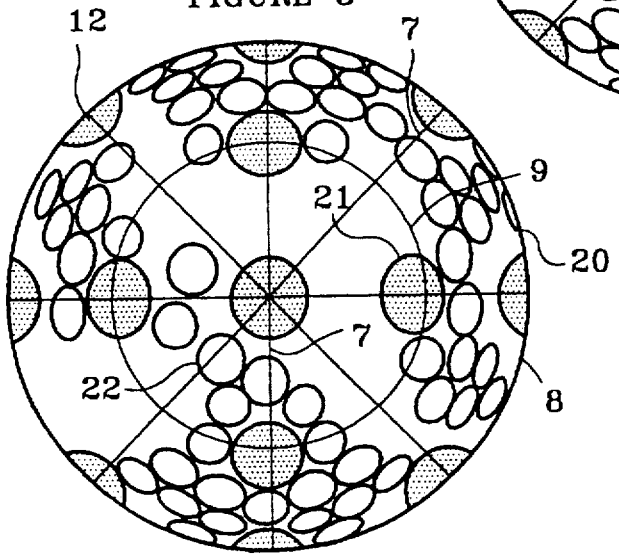

FIG. 3 is a plan view of golf ball 20 and shows eight lands 12 at the intersections of longitudinal vertical great circles 7 spaced 45 degrees apart and an equatorial latitudinal circle 8. Four lands 21 are positioned 90 degrees apart among dimples 22 where longitudinal vertical great circles 7 intersect middle latitudinal circles 9 spaced 45 degrees above and below latitude 8. A differentiated land need not be positioned at the intersection of all the longitudinal vertical great circles 7. This approach is taken to reduce clutter on the ball surface and for improving the putter's ability to differentiate between lands when in a putting position while improving the visual continuity of a line of lands 12 around the top of a properly positioned ball.

GENERAL DESCRIPTION OF THE INVENTION

The balls of this invention are designed to preferably simultaneously provide lands at the point where the ball touches the green and the putter touches the ball to reduce putting aberrations caused by uneven contact surface in each instance. Further, the symmetrically positioned lands on the sides and top of the ball enable the golfer to visually align the ball with the intended putt from a position behind or above the ball looking toward the hole.

Land size is determined by the visibility of the lands, the coarseness of the putting green grass, and the loft of the putter. Land sizes will vary from about 5 mm to about 10 mm (3/16"–3/8") and are preferably from about 6.3 mm.–9.5 mm. The land positioning is preferably 45° or 90° from the positioning of the adjacent lands on longitudinal great circles and latitudinal circles. However, the lands can also be placed along other circles, e.g., those which are 30° apart in the vertical and horizontal dimensions. The 30° configuration always provides the right angle sighting needed for improved putting in all cases. A 60° design, however, does not.

In all cases, a land should touch the surface of the green when the ball is properly aligned for contact with the putter, i.e., there should always be lands 90° from the land touching the turf. The lands should cover between about 3% and about 15% of the ball surface and can cover between about 2% and about 20% or more of the surface. The colors of lands can range from white to black with a variety of other single colors, combinations of colors and combinations of fluorescent and nonfluorescent colors. The lands are preferably smooth but can be dimpled as per Kubashi and others.

I claim:

1. A golf ball having a surface substantially made up of dimples and lands, all of said lands being substantially undifferentiatable from each other when viewed by a golfer who is in position and putt said ball, the but for a plurality of substantially smooth, discrete lands which are visually differentiatable from the remainder of the lands when viewed by the golfer who is in position to putt said ball and which are located at the intersections of, when viewed in cartographic projection, at least one, longitudinal great circle and, perpendicular thereto, at least one intersecting latitudinal circle with the at least one intersecting latitudinal circle being located at the equator of the surface of the ball.

2. The golf ball of claim 1 wherein the lands are at least about 5 mm across.

3. The golf ball of claim 1 including a plurality of longitudinal great circles spaced 45 degrees around the ball surface, and a plurality of latitudinal circles are positioned at the equator and 45 degrees above and below the equator.

4. The golf ball of claim 1 including a plurality of longitudinal great circles spaced 90 degrees from each other around the ball surface.

5. The golf ball of claim 1 wherein the lands are between about 5 mm and 10 mm across.

6. The golf ball of claim 1 wherein the lands are between about 6.3 mm and 9.5 mm across.

7. The golf ball of claim 1 wherein at least part of the differentiatable lands have at least one color which differs from that of the dimpled portion of the ball surface.

8. The golf ball of claim 7 wherein the at least one color is fluorescent.

9. The golf ball of claim 1 having a plurality of vertical, longitudinal great circles spaced at least 30 degrees apart around the surface of the ball and at least one latitudinal circle intersecting the vertical longitudinal great circles at right angles.

10. The golf ball of claim 1 having a plurality of vertical, longitudinal great circles spaced at least 30 degrees apart around the surface of the ball and a plurality of horizontal latitudinal circles spaced at least 30 degrees apart around the surface of the ball at right angles to the longitudinal great circles.

* * * * *

UNITED STATES PATENT AND TRADEMARK OFFICE

CERTIFICATE OF CORRECTION

PATENT NO. : 5,662,530
DATED : September 2, 1997
INVENTOR(S) : John G. Sellar

It is certified that error appears in the above-identified patent and that said Letters Patent is hereby corrected as shown below:

The title page, showing the illustrative figure, should be deleted and substitute therefor the attached title page.

In the drawing figure 1, extend the lead line from the number "8" to the horizontal line bisecting the lands 12 as shown on the attached page.

Column 2, line 7: Delete "as the" and insert therefor --. The--.

Column 2, line 8: After "casing," insert --and--.

Column 2, line 55: Delete "in diameter" and insert therefor --across--.

Column 3, line 10: Delete "10" and insert therefor --6--.

Column 4, line 15: Delete "and" and insert therefor -- to --.

Signed and Sealed this

Third Day of February, 1998

Bruce Lehman

BRUCE LEHMAN

*Commissioner of Patents and Trademarks*

*Attest:*

*Attesting Officer*

United States Patent [19]

Sellar

[11] Patent Number: 5,662,530

[45] Date of Patent: Sep. 2, 1997

[54] GOLF BALL

[76] Inventor: John G. Sellar, 6045 W. Evans Pl., Lakewood, Colo. 80227

[21] Appl. No.: 288,606

[22] Filed: Aug. 10, 1994

[51] Int. Cl.[6] ..... A63B 69/36; A63B 37/14

[52] U.S. Cl. ..... 473/268; 473/353; 40/327

[58] Field of Search ..... 273/213, 232; 473/280, 353, 165, 268; 40/327

[56] References Cited

U.S. PATENT DOCUMENTS

| | | | |
|---|---|---|---|
| 676,506 | 6/1901 | Knight et al. | 273/213 |
| 1,795,732 | 3/1931 | Miller | 273/213 |
| 4,235,441 | 11/1980 | Ciccarello | 273/213 |
| 4,258,921 | 3/1981 | Worst | 273/232 |
| 4,346,898 | 8/1982 | Badke | 273/232 |
| 4,706,958 | 11/1987 | Inoue | 273/213 |
| 4,798,386 | 1/1989 | Berard | 273/235 R |
| 5,013,046 | 5/1991 | Koch | 273/235 R |
| 5,067,719 | 11/1991 | Mook | 273/213 |
| 5,127,655 | 7/1992 | Yamada et al. | 273/232 |
| 5,209,485 | 5/1993 | Nesbitt et al. | 273/235 R X |

*Primary Examiner*—George J. Marlo

[57] ABSTRACT

A golf ball providing better putting results from the placement of lands along intersecting, cartographically speaking, longitudinal great circles and latitudinal circles in a manner that permits the golfer to align the putter with the hole by viewing a line of lands running over the upper surface of a golf ball while simultaneously placing an opposed bottom land on the putting green and a second land at a position 90° from the bottom land for contact with the putter when the top and bottom lands are perpendicular to the surface of the green.

The circles can be at 30°, 45° or 90° apart. Preferably, the circles are 45° or 90° apart, the lands are sized from 5 mm to 10 mm and cover up to about 20% of the ball surface. Preferably, the lands are colored.

10 Claims, 1 Drawing Sheet

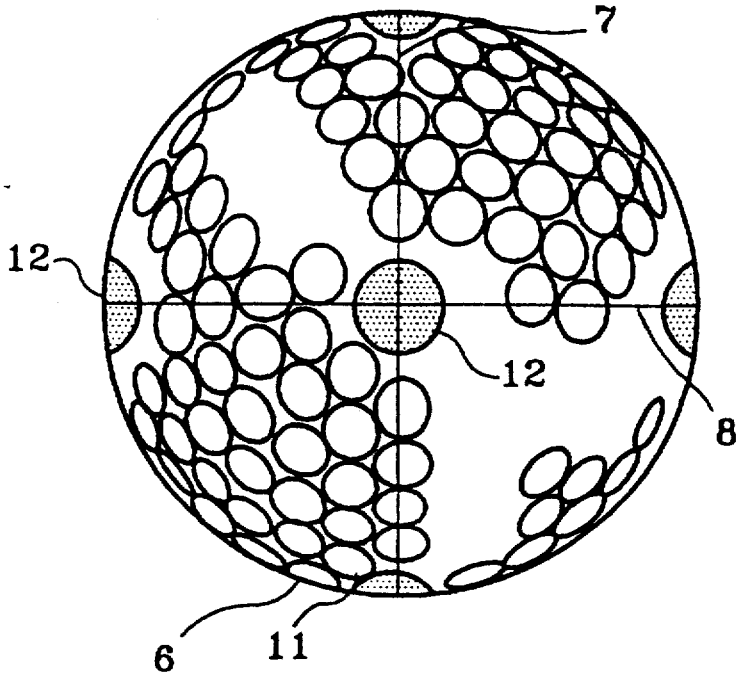

UNITED STATES PATENT AND TRADEMARK OFFICE

CERTIFICATE OF CORRECTION

PATENT NO. : 5,662,530

DATED : September 2, 1997

INVENTOR(S) : John G. Sellar

It is certified that error appears in the above-identified patent and that said Letters Patent is hereby corrected as shown below:

Column 4, line 15 (claim 1), delete "the".

Signed and Sealed this

Twenty-ninth Day of September, 1998

*Attest:*

Bruce Lehman

BRUCE LEHMAN

*Attesting Officer*

*Commissioner of Patents and Trademarks*